United States Patent [19]

Nestorovic et al.

[11] 3,984,635

[45] Oct. 5, 1976

[54] LOW RANGE LOUDSPEAKER SYSTEM

[75] Inventors: Mioljub R. Nestorovic, Binghamton; Richard Modafferi, Vestal, both of N.Y.

[73] Assignee: Electro Acoustical Labs, Inc., New York, N.Y.

[22] Filed: Mar. 11, 1975

[21] Appl. No.: 557,272

[52] U.S. Cl. ..... 179/1 E

[51] Int. Cl.[2] ..... H04R 1/28

[58] Field of Search ..... 179/1 D, 1 E

[56] References Cited

UNITED STATES PATENTS

| | | | |
|---|---|---|---|
| 1,931,235 | 10/1933 | Nicolson | 179/1 D |
| 3,155,774 | 11/1964 | Howell | 179/1 E |
| 3,720,787 | 3/1973 | Ishii et al. | 179/1 E |

FOREIGN PATENTS OR APPLICATIONS

| | | | |
|---|---|---|---|
| 803,624 | 1/1969 | Canada | 179/1 E |

*Primary Examiner*—George G. Stellar

[57] ABSTRACT

An audio speaker system that provides enhanced fidelity of sound reproduction in the bass acoustic frequency range, by comprising a usual driven primary radiator, a pair of conductors for connecting the primary radiator to its energy source, a driven auxiliary radiator connected to that pair of conductors via a reactive network, both radiators being acoustically coupled by being housed in a closed cabinet common to both of them except for the respective separate diaphragm openings for each of said radiators, and the respective function and value of the individual component elements of said network relative to one another and the volume of the cabinet are such as to have the system operate on the bass-reflex principle.

15 Claims, 8 Drawing Figures

11
10
+
LS1
Za
14
LS2
INPUT
Zb
−
13
12

11
10
+
LS1
FROM
CROSSOVER
NETWORK
C
LS2
−
13
12

11
10
+
LS1
FROM
CROSSOVER
NETWORK
LS2
C
R
−
13
12

11
10
+
LS1
R
C
LS2
FROM
CROSSOVER
NETWORK
−
13
12

11
10
+
LS1
C
R1
LS2
FROM
CROSSOVER
NETWORK
R2
−
13
12

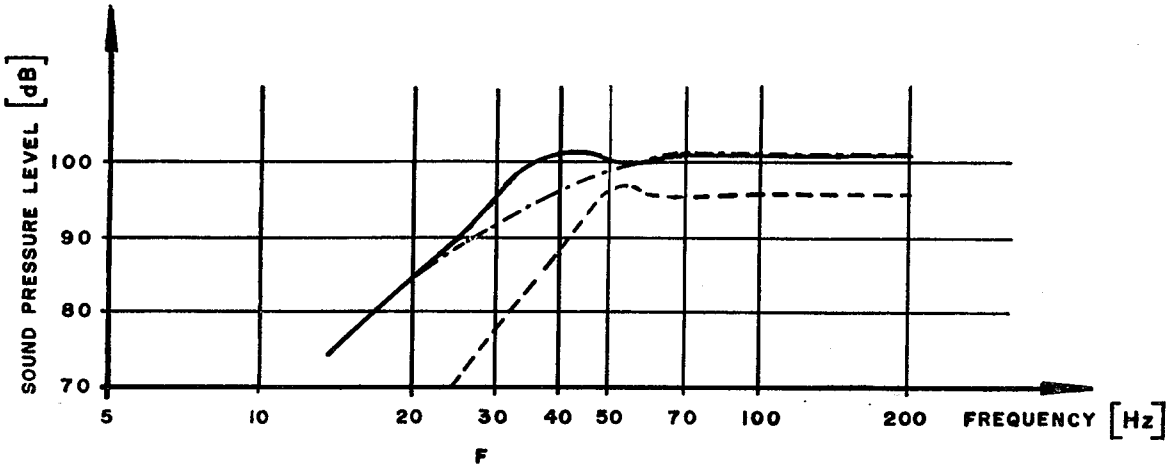
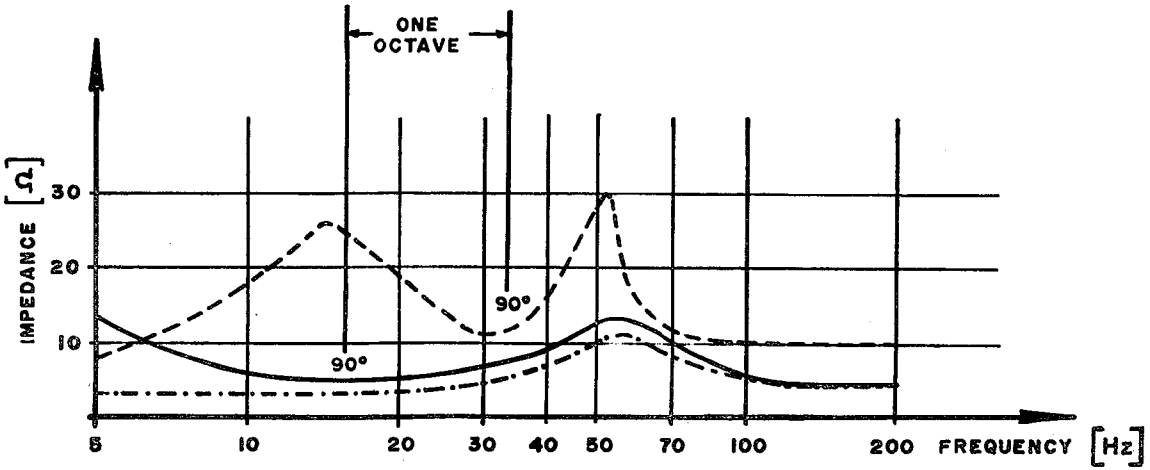
FIG. 3
FREQUENCY RESPONSE
- - - - PASSIVE RADIATOR
-·-·-·- PARALLEL CONNECTION
——— ACTIVE BASS REFLEX
FIG. 4
IMPEDANCE VS. FREQUENCY

LOW RANGE LOUDSPEAKER SYSTEM

This invention is that of a loudspeaker, or audio speaker, system which avoids the sound fidelity reproduction shortcomings especially in low frequency response in a loudspeaker system using its driven speaker alone or with only a cabinet port or a vent substitute such as a passive speaker cone. The audio speaker system of the invention provides high fidelity sound reproduction, especially in the low frequency response, highly superior to the reproduction heretofore attained. The system of the invention accomplishes that by replacing the port or passive bass-reflex vent substitute of the earlier systems by a loudspeaker mechanism that is provided with an electrical driving signal through a reactive electrical network.

Any audio speaker system that includes this innovationn of the invention is referred to as "an active bass-reflex loud-speaker system".

One of the problems inherent in any loudspeaker system operating on the bass-reflex principle is that as the sound frequency is reduced, a level is reached where the (sound) radiation from the driven primary radiator and its associated port (or vent substitute) becomes significantly out of phase. This very seriously limits the low frequency response of such earlier audio system.

The present invention overcomes that problem and eliminates that limitation in the low frequency response, by including in the same cabinet which encloses the customary driven primary radiator, a loudspeaker mechanism that receives an electrical signal via a reactive electric network and through a branch from the same conductor that conducts the electrical signal to the primary loudspeaker from its energy source. This driven vent substitute, conveniently called a driven auxiliary radiator, provides a radiated acoustic output with (wave) phase shift of less than 90°, with respect to that for the primary radiator, and to a much lower frequency than possibly could be attained if the auxiliary radiator were merely a port or passive loudspeaker mechanism such as a passive cone.

The instant invention thus provides a method and means for electrically driving two speakers both housed in the same closed (except for the speaker cone openings) compartment or box and in such a manner that extends the low frequency response of the speaker system without degrading its overall efficiency or response at the higher frequencies. The invention thus also provides a method for attaining the just noted result.

That just earlier above related result provided by the speaker system of the invention is assumed as being attained without using any external frequency equalizer. However, that does not bar the possibility of also using external frequency equalization in this new system although, as initially related, this new system can be so designed as not to require external frequency equalization.

Experimentation with the generally illustrated circuit shown in the circuit diagram in FIG. 1 below provided several specific circuits (within the invention) which extend the earlier attained limited low frequency response from a passive radiator bass-reflex loudspeaker as much as one octave lower, by replacing the passive speaker or radiator mechanism of that earlier speaker system by an electrically driven loudspeaker mechanism.

Broadly considered, the invention is an audio speaking system having a usual driven primary radiator, a pair of positive and negative conductors for connecting the primary radiator to its energy source, a driven auxiliary radiator connected to the pair of conductors via a reactive network, both radiators being housed in a compartment (or cabinet) common to and enclosing both of them except for the two respective speaker cone front openings, and the component elements of the network are so selected as to respective function and value relative to one another and the volume of the cabinet to induce the system to operate on the bass-reflex principle, whereby the system provides high fidelity sound reproduction.

The housing of both radiators in a common compartment, as just above described, encloses them as acoustically coupled, thereby providing acoustic coupling between the rear of the respective diaphragm of each of the primary and auxiliary radiators, as a significant feature in having them operate on the bass-reflex principle.

The initial illustration of the bass-reflex principle is shown in U.S. Pat. No. 1,869,178 issued July 26, 1932 to Albert L. Thuras, for example, by providing an open port extending from the compartment which houses the sole radiator through to the exterior of the same wall which supports the radiator and in proximity to the latter.

Another feature of the invention is that in it, as just above broadly considered, the cone mass of the auxiliary radiator is at least equal to, and better yet significantly higher than, that of the primary radiator.

A further feature of the invention, as above broadly considered, is that the compliance of the auxiliary radiator is greater than that of the primary radiator and up to as much higher as is practically possible yet to maintain the physical integrity of the cone, as well as the cone's effectiveness for its function.

Yet an additional feature of the invention along with it, as above broadly considered, is that the self resonance in free air of the auxiliary radiator is lower, and better yet up to at least fifty percent lower, than that of the primary radiator.

The broadly considered aspect of the invention as shortly earlier presented can be viewed differently as having the driven auxiliary radiator in apparently parallel connection relative to the driven primary radiator and with the reactive network interposed between the positive conductor and the auxiliary radiator being an impedance adapted to provide the foregoing and later below described desired operation of the invention; and with or without another such impedance connected from a point between the first impedance and the auxiliary radiator and to the negative conductor so as, if this other impedance is included, to appear in parallel connection to the auxiliary radiator.

The various features of the invention can be more readily followed from the further below detailed description of generic and specific embodiments of it, and in relation to the accompanying drawings wherein.

FIGS. 3 and 4 show the acoustic output and efficiency of the active bass-reflex loudspeaker system represented by the circuit diagram of FIGS. 5(*b*) and 6 as compared with the corresponding results provided by (i) a system having a passive radiator vent substitute instead of the driven auxiliary radiator used in the invention, and (ii) a loudspeaker system having an auxiliary radiator connected in ordinary parallel with the primary radiator without any interposed reactive electric network between the auxiliary radiator and any of the conductors.

Figures 1, 2, 5A, 5B, 5C:
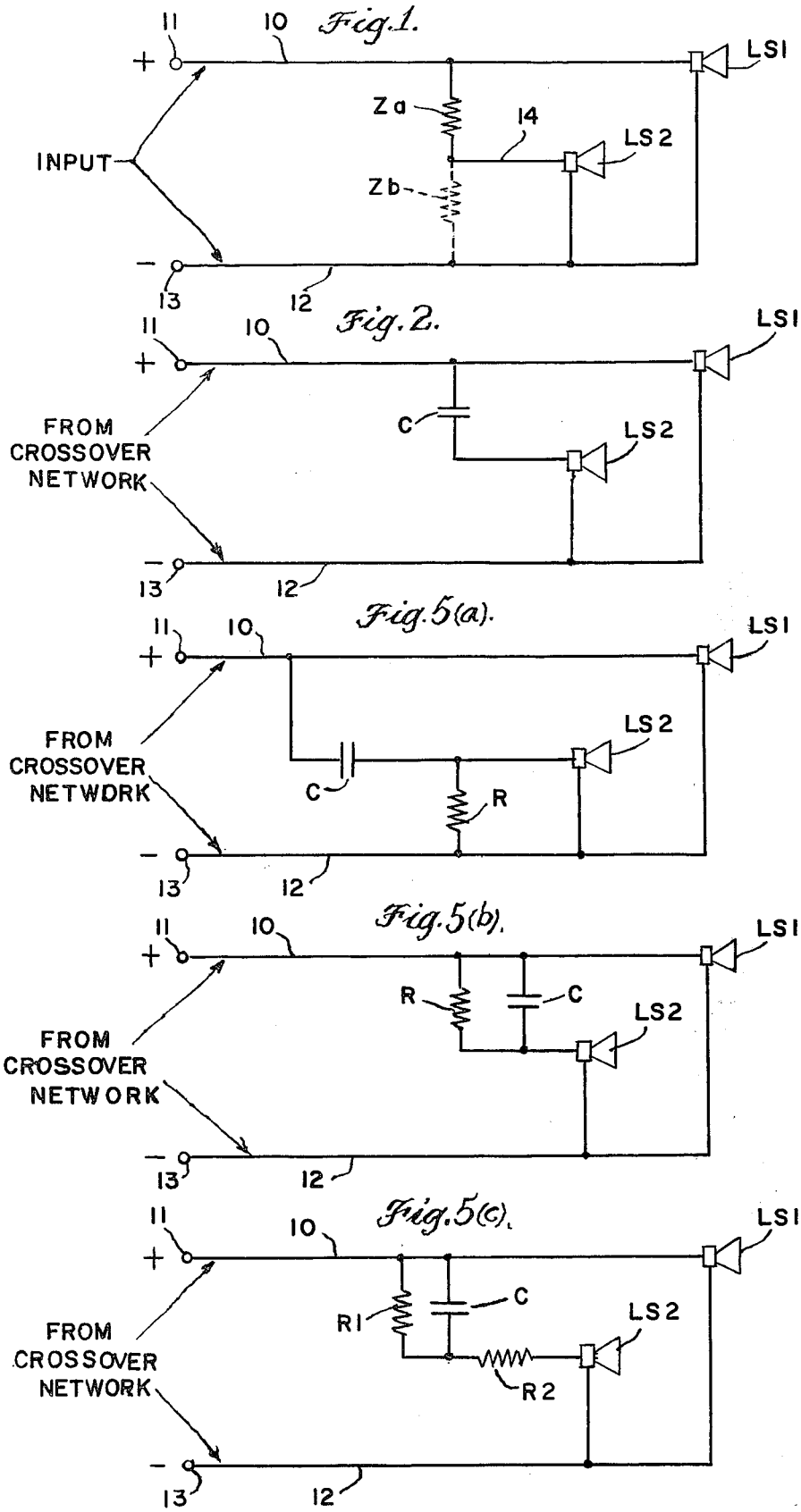
FIG. 1 is a circuit diagram generic to specific embodiments of the invention shown in FIGS. 2, and 5(*a*) to 6. In the diagram the symbol Z, as usual, represents an impedance.
FIG. 2 is the circuit diagram for the simplest embodiment of the invention, wherein the interposed impedance is the capacitor C.

FIG. 5(*a*) shows a circuit diagram like that of FIG. 2, but with a resistor (R) connected in parallel with the auxiliary radiator, at a point between the latter and the capacitor and with the other end connected to the negative conductor.

FIG. 5(*b*) is a circuit diagram like that of FIG. 5(*a*) but with the resistor connected in parallel to the capacitor and instead of having one end connected to the negative conductor the resistor has an end connected to the positive conductor.

FIG. 5(*c*) is a circuit diagram like that of FIG. 5(*b*), but in addition has a second resistor with one end connected to the inner connection between the first resistor and the capacitor and the other connected with the driven auxiliary radiator.

Figure 6:
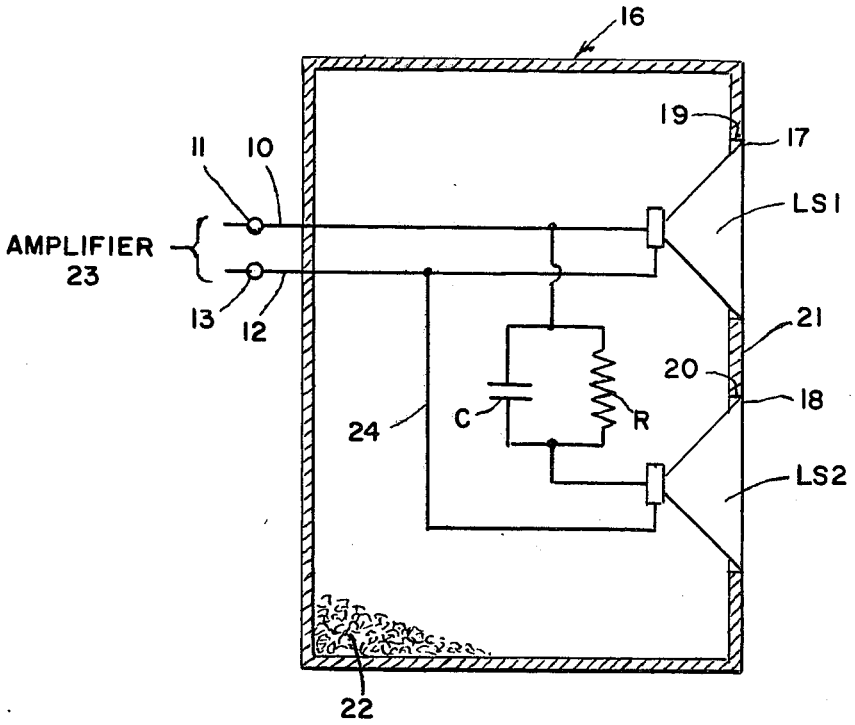

FIG. 6 is a vertical cross-sectional view along the vertical plane extending perpendicular to the front and rear walls of a loudspeaker cabinet and passing centrally through the axis of the cone and voice coil of each of the vertically spaced apart driven primary and driven auxiliary radiators, and showing schematically the relationship between both driven radiators and a circuit similar to that of FIG. 5(*b*).

In each of the figures other than 3 and 4 the reference symbol LS1 stands for the driven primary radiator and corresponds to the speaker mechanism usually referred to in a bass-reflex system as the main or primary radiator, and LS2 stands for the active or driven auxiliary radiator and, as also already indicated, replaces the passive radiator in a vent-substitute bass-reflex system. Then also, the respectively interconnected components in the circuit diagram of each of those figures also can be deployed in a cabinet or other compartment suitably dimensioned respectively for each of them.

The advantage contributed by the invention by eliminating that limitation in the low frequency response experienced with the speaker systems that included only a vent in their cabinets or a passive vent substitute, was attained even if the interior of the cabinet housing a driven auxiliary radiator with a circuit as in the invention did not include a sound absorbing material such as glass wool, or some other suitable such material. However, when such a dampener was included, as is customary with most speakers, the advantage contributed by the invention was even better.

Also in each of the figures other than 3 and 4, the positive and negative conductors (at the input end of the circuit) are connected to the respective energy feeder lines, for example, a cross-over network from an amplifier, which are a common feeder lines source for the energy to be provided to the loudspeaker system.

The drawings other than FIGS. 3 and 4 also show that the one, two or three impedances (seen in them) constitute the essential reactive network included in the active bass-reflex loudspeaker system of the invention.

The circuit diagram of FIG. 2 is for the simplest active bass-reflex loudspeaker system and is one that is commercially attractive because of its simplicity and also low cost. In the circuit of FIG. 2 radiator LS1 behaves as the primary, active driver at all input frequencies. Radiator LS2 operates in parallel with LS1 at the upper end of the desired frequency range and behaves similar to a passive radiator at the lower end of that range, because of including the reactive network.

Both of these radiators are speaker mechanisms with generally different physical parameters. For example, in the FIG. 2 embodiment of the invention, LS1 and LS2 could have substantially identical cone size and compliance; but LS2 will have greater, for example, at times twice, the cone mass of LS1 and generally a larger magnet structure than that of LS1.

Electroacoustics measurements of the active bass-reflex loudspeaker system of FIG. 2 show good improvement in low frequency response over the use of the same two speakers connected as a bass-reflex system but wherein radiator LS2 merely is a passive radiator (and thus without any electrical connection to it). The active bass-reflex loudspeaker system also provides improved low frequency response over a system having two electrically driven speakers that are connected merely in parallel, that is, without any reactive network interposed ahead of radiator LS2.

Thus, non-linear distortion for the active bass-reflex loudspeaker system of FIG. 2 is significantly lower than is the case when both of the speakers are electrically connected merely in simple parallel. The lower distortion occurs in the active bass-reflex loudspeaker system because at the lower frequencies where the cone excursion requirement is greatest, radiator LS2 begins to behave in a manner similar to a passive radiator. At those lowest audible frequencies, the high distortion that would be produced by the non-linearities of the magnet-voice coil assembly of radiator LS2 when merely in simple parallel connection is minimized because in the active bass-reflex system the electrical drive to LS2 is reduced by the increased impedance of the capacitor.

As is known, loudspeaker driver non-linear distortion results from two basic mechanisms, namely, (i) non-linearities in the magnet voice coil assembly, and (ii) to a lesser degree non-linearities in the cone material and the cone suspension. Advantageously, in the active bass-reflex system low frequency distortion in LS2 results primarily from the non-linearity of the cone suspension.

The graphs of FIGS. 3 and 4 compare acoustic output (FIG. 3) and impedance (FIG. 4) of the embodiment of the invention shown in FIGS. 2 and 6 with the acoustic output and impedance of two other loudspeaker systems with the same parameters and without a reactive network with (i) one of them having a passive auxiliary radiator, and (ii) the other having a driven auxiliary radiator but connected only in ordinary parallel to the primary radiator.

The data shown by the graphs in FIGS. 3 and 4 demonstrate the advantages provided by the active bass-reflex loudspeaker system of the invention. The curves in FIG. 3 show that the frequency response for the system having only ordinary parallel connection and for the active bass-reflex system are similar at the higher frequencies. At and below the knee of the frequency response curve, the active bass-reflex system is seen to provide increased acoustical output, with flatter frequency response when compared with the curve for the system having two ordinary parallel-connected radiators.

The curves in FIG. 4 show that the impedance for the system with the two ordinary parallel-connected radiators is the lowest for the three compared systems.

The curves of FIGS. 3 and 4 show that the active bass-reflex loudspeaker system of the invention provides two definite improvements over the system having two ordinary parallel-connected radiators, namely, (i) better frequency response, and (ii) better efficency at low frequencies.

Comparison of the efficiency at very low impedance shows that the efficiency manifested by the active bass-reflex loudspeaker system is far superior to the efficiency shown by the system using two ordinary parallel-connected radiators. That is so because of the much higher impedance developed in the loudspeaker system of the invention at these very low frequencies (as seen in FIG. 4) where the active bass-reflex loudspeaker system provides significantly more acoustic output than the system using only ordinary parallel connection.

The curves in FIG. 3 show the extension of low frequency response provided by the active bass-reflex system as compared with that of the system having only a passive auxiliary radiator. The reason for the lesser frequency response rolloff in the active bass-reflex system can be deduced from the impedance curves of FIG. 4. For example, the valley of the impedance curve (showing the 90° phase shift between the primary and auxiliary radiators) has been shifted down approximately one octave in the active bass-reflex system as compared with what is shown for the system having the passive auxiliary radiator.

That means that by using the active bass-reflex loudspeaker system the output from the active auxiliary radiator does not begin to cancel the output from the primary radiator until a much lower frequency is reached than occurs in the case of the loudspeaker system using a passive auxiliary radiator.

As more fully described further below in relation to FIG. 6, the driving or input signals for operating the circuit of the respectively illustrated active bass-reflex loudspeaker of the invention in each of the figures other than 3 and 4 comes from an exterior (not shown) component, such as an amplifier or crossover network which is hooked up to positive conductor 10 at its terminal 11, and the current returns to that component from negative conductor 12 at its terminal 13, for example, in FIG. 1 and as better seen in FIG. 6.

As indicated above the reactive network in FIG. 1 can be merely a single impedance *Za* connected through a conductor 14 to speaker LS2, with or without another impedance *Zb* connected between impedance *Za* and negative conductor 12. Thus, the impedance *Zb* is shown in phantom in FIG. 1 to indicate that the individual specific circuits may either include it or not.

The circuit represented in FIG. 2 then is a specific example of the generic circuit of FIG. 1 with only one impedance, namely, capacitor C, and does not include any other impedance.

Then, the circuit of FIG. 5(*a*) is a different specific terminal combination including specifically the capacitor C (as in FIG. 2) and the resistor R, as in FIG. 5(*a*), but with resistor R, instead of being connected to negative conductor 12, being connected to positive conductor 10 and in parallel to capacitor C.

FIG. 5(*c*) is a further example embraced by the generic circuit of FIG. 1 and specifically like that of FIG. 5(*b*), but having a second resistor $R_2$ interposed between speaker LS2 and the two-component impedance made up of capacitor C and resistor $R_1$ in FIG. 5(*b*).

OPERATION OF EMBODIMENT OF INVENTION IN FIG. 6

FIG. 6 shows the circuit of FIG. 5(*b*) housed in cabinet 16 (having internal volume of about 2.5 cubic feet) and with the outermost circular free peripheral ends 17 and 18 of the (12 inch diameter) primary and auxiliary radiators LS1 and LS2 respectively in registry with cone openings 19 and 20 in the cabinet's front wall 21. The air volume of the inside of cabinet 16 is filled substantially entirely with loosely packed sound absorbing material, specifically glass wool 22 (although any other such material suitable for that use can be used).

FIG. 6 shows that the air volume within its cabinet 16 directly communicates with the rear of the respective diaphragm of each of the primary and auxiliary radiators thereby providing acoustic coupling between them.

The self resonance in free air of primary radiator LS1 is 17 Hz (Hertz units) while that for the auxiliary radiator LS2 is 10 Hz. The compliance of speaker LS2 is as high as was practical to make it for the effectiveness for its function.

Positive conductor 10 is connected at its terminal 11 (outside of cabinet 16) to the lead coming from amplifier 23 which is the source for the energy furnished to operate this active bass-reflex loudspeaker system, initially going to the voice coil of speaker LS1. The current continues on through the circuit and from speaker LS1 flows through negative conductor 12 to its terminal 13 and from there back to amplifier 23.

The reactive network consisting of the two-terminal combination of a capacitor C and resistor R electrically connects the voice coil of speaker LS2 to positive conductor 10, and current leaving speaker LS2 flows through conductor 24 to negative terminal 12 and then on to return to amplifier 23. Resistor R has a value of 25 ohms and is capable of dissipating at least 10 watts. Capacitor C has capacitance of about 500 microfarads and is capable of carrying alternating currents.

This capacitor value of 500 microfarads along with the 2.5 cubic feet volume of cabinet 16 and the self-resonance value of 17 Hz and 10 Hz respectively of the primary and auxiliary radiators are the respective values of component elements of the system relative to one another, or in other words, are the system parameters, which jointly participate in providing the improved performance including enhanced sound reproduction especially in the low frequency response, in the particular embodiment of the invention shown in FIG. 6.

In operating the embodiment shown in FIG. 6, when short circuit, thus effectively connecting speakers LS1 and LS2 electrically in parallel. As the frequency of the driving signal lowers, for example, to the region of 45 Hz, the two loudspeakers LS1 and LS2, together with the air in cabinet 16, reach a resonance point which is shown as the higher frequency peak of impedance in FIG. 4.

Then, as the driving frequency is reduced further, say, to the region of about 25 Hz, the electrical drive to speaker LS2 is reduced by the increasing reactance of capacitor C so that speaker LS2 operates similarly to a passive auxiliary radiator to provide bass-reflex action. In this frequency region where bass-reflex action occurs, the impedance curve seen in FIG. 4 is in the valley region between the higher and lower peaks.

As the frequency of the driving signal is reduced to the subsonic region, such as below 5 Hz, the reactance of capacitor C becomes very large and thus capacitor C becomes effectively an open circuit with the result of effectively removing the electrical drive signal from speaker LS2. This very low frequency corresponds to the lower frequency impedance peak seen in FIG. 4. At these subsonic frequencies the cone excursions of the speakers LS1 and LS2 will tend to become excessive if the driving signal at terminals 11 and 13 is large. That is so because the cones of speakers LS1 and LS2 will tend to vibrate out of phase so that the air in the cabinet 16 no longer dampens these cones.

To prevent the occurrence of this successive movement of the cones of speakers LS1 and LS2 at subsonic frequencies, resistor R is included in the circuit. Resistor R will tend to damp the cone excursions of speakers LS1 and LS2 in the subsonic frequency region by introducing sufficient in-phase drive signal to speaker LS2. Thus, the cones of speakers LS1 and LS2 will tend to vibrate in-phase at subsonic frequencies instead of out of phase and thereby allow the air in cabinet 16 to limit the cone movements of speakers LS1 and LS2 to safe values.

The inclusion of resistor R in parallel with capacitor C, as shown in FIG. 6, further enhances the performance of the system, for example, by reducing the height of each of the impedance peaks as shown by the impedance graph of FIG. 4.

In addition, further dampening of speaker LS2 is provided by the electromagnetic braking action of the counter-electromotive force produced by the voice coil of speaker LS2 acting in the low-impedance circuit consisting of the voice coil of LS2, resistor R and the internal impedance of the amplifier 23.

In the active bass-reflex loudspeaker system of the invention the component elements of the reactive network are so selected relative to one another, as seen from the descriptions of the foregoing illustrative circuits and the comparative results presented in FIGS. 3 and 4, that with the network in operation the system (i) allows the two radiators to operate as being connected in parallel at the upper portion of the useful frequency range, and (ii) allows the auxiliary radiator to behave as a passive radiator at the low end portion of the frequency range, thereby to provide a more extended low frequency range of sound radiation and enhanced low frequency efficiency over that provided by the available variations of the conventional bass-reflex system.

Such selection of the component elements of this electrical reactive network provides an electrical energy drive to the auxiliary radiator that enables it to radiate in phase with the primary radiator, and to a frequency of about one octave lower than what would be reached without the active drive to the auxiliary radiator.

The cone mass of the active auxiliary radiator LS2, in exceeding that of primary speaker LS1, can be of such higher value as the design parameters suitable for the proper function of the auxiliary radiator require.

The mere 2.5 cubic feet internal volume of the cabinet of the above-described embodiment of the invention as illustrated by FIG. 6 shows that the audio speaker system of the invention can be presented in relatively small or moderate size.

While the invention has been explained by detailed description of certain specific embodiments of it, it is understood that various changes and/or substitutions may be made in any of them within the scope of the appended claims which are intended also to cover equivalents of these described specific embodiments.

What is claimed is:

1. An audio speaker system comprising the usual driven primary radiator having a cone and a voice coil and capable of responding to audio frequency signals extending over a wide range including an upper or high frequency range and down to a lower or bass frequency range, a pair of conductors for connecting said primary radiator to its energy source, a driven auxiliary radiator having a cone of a voice coil, a reactive network which is connected in series with the voice coil of said auxiliary radiator, said series combination of said reactive network and auxiliary radiator being connected in parallel with the voice coil of said primary radiator, both of said radiators being housed and acoustically coupled in a closed cabinet common to both of them except for the respective cone opening for each of said radiators, the cone size, compliance and mass of each of said radiators, and the component elements of the network as to respective function and value relative to one another and the volume of said cabinet being such that at the upper portion of the useful frequency range of said audio signals said primary and auxiliary radiators operate substantially as though they are connected directly in parallel, and at the base portion of said frequency range of sound radiation said auxiliary radiator operates to enhance the bass frequency efficiency of the acoustic output and to extend the bass frequency response range of said audio speaker system to a still lower level.

2. An audio speaker system of claim 1, wherein the compliance of the auxiliary radiator is greater than that of the primary radiator and up to as much higher as is practically possible yet to maintain the physical integrity of the cone and its function.

3. An audio speaker system of claim 1, wherein the self resonance in free air of the auxiliary radiator is lower than that of the primary radiator.

4. An audio speaker system of claim 1, wherein the cone mass of the auxiliary radiator is at least equal to, and better yet significantly higher than, that of the primary radiator and up to such higher value as the design parameters suitable for the proper function of the auxiliary radiator require.

5. The audio speaker system of claim 4, wherein the reactive network is a capacitor in series with the auxiliary radiator.

6. The audio speaker system of claim 1, wherein the component elements of the reactive network as to respective function and value relative to one another are such that with the network in operation the system (i)

allows the two radiators to operate as being connected in parallel at the upper portion of the useful frequency range, and (ii) allows the auxiliary radiator to behave as a passive radiator at the low end portion of the frequency range, thereby to provide a more extended low frequency range of sound radiation and enhanced low frequency efficiency over that provided by the available variations of the conventional bass-reflex system.

7. The audio speaker system of claim 6, wherein said relationship of the component elements of the reactive network is such that provides an electrical energy drive to the auxiliary radiator in such a manner that the auxiliary radiator remains in phase with the primary radiator to a frequency of approximately one octave lower than what would be reached without the active drive to the auxiliary radiator.

8. The audio speaker system of claim 1, wherein the reactive network has (i) an impedance electrically connected between the positive conductor and the driven auxiliary radiator, or (ii) the impedance as in (i) and a second impedance connected with the auxiliary radiator.

9. The audio speaker system of claim 8, which has a single impedance connected between the positive conductor and the auxiliary radiator.

10. The audio speaker system of claim 9, wherein the impedance is a capacitor.

11. The audio speaker system of claim 8, wherein the network has two impedances.

12. The audio speaker system of claim 11, wherein one impedance is a capacitor and the other is a resistor.

13. The audio speaker system of claim 12, wherein the resistor is connected in series with the capacitor and in parallel with the auxiliary radiator and then to the negative conductor.

14. The audio speaker system of claim 12, wherein both the resistor and the capacitor are connected in parallel to one another.

15. The audio speaker system of claim 14, wherein a second resistor is connected between the auxiliary radiator and the nearer to it junction of the parallel-connected capacitor and first resistor.

* * * * *